US012560044B2

(12) United States Patent
Berthaud et al.

(10) Patent No.: US 12,560,044 B2
(45) Date of Patent: Feb. 24, 2026

(54) LOCK SEQUENCING SYSTEM FOR A BLOWOUT PREVENTER

(71) Applicant: Schlumberger Technology Corporation, Sugar Land, TX (US)

(72) Inventors: Pascal Berthaud, Beziers (FR); Jean-Luc Pujol, Beziers (FR); Benoit Jauzion, Beziers (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 196 days.

(21) Appl. No.: 18/559,996

(22) PCT Filed: May 11, 2022

(86) PCT No.: PCT/US2022/072237

§ 371 (c)(1),
(2) Date: Nov. 9, 2023

(87) PCT Pub. No.: WO2022/241422

PCT Pub. Date: Nov. 17, 2022

(65) Prior Publication Data

US 2024/0240535 A1 Jul. 18, 2024

Related U.S. Application Data

(60) Provisional application No. 63/201,798, filed on May 13, 2021.

(51) Int. Cl.
*E21B 33/06* (2006.01)

(52) U.S. Cl.
CPC ..... *E21B 33/062* (2013.01)

(58) Field of Classification Search
CPC ..... E21B 33/06; E21B 33/064; E21B 34/16; E21B 34/06; E21B 34/02; F15B 15/26; F16D 9/00; F16K 16/00; B61C 9/00
(Continued)

(56) References Cited

U.S. PATENT DOCUMENTS 3,208,357 A * 9/1965 Allen ..... E21B 33/062 92/61
3,242,826 A * 3/1966 Smith ..... E21B 33/062 92/24

(Continued)

FOREIGN PATENT DOCUMENTS

CN 105416305 A 3/2016
JP 2008069818 A 3/2008

(Continued)

OTHER PUBLICATIONS

International Search Report and Written Opinion issued in International Patent application PCT/US2022/072237 on Sep. 2, 2022, 8 pages.

(Continued)

*Primary Examiner* — Daphne M Barry
(74) *Attorney, Agent, or Firm* — Jeffrey D. Frantz

(57) ABSTRACT

A lock sequencing system includes a first fluid line that couples a fluid source to a first portion of a piston cavity of a blowout preventer and to a hydraulic motor of a lock. A first discharge valve is positioned along the first fluid line to delay delivery of fluid to the hydraulic motor of the lock to cause sequential closure of a ram coupled to the piston and locking of a locking member of the lock. A second fluid line couples the fluid source to a second portion of the piston cavity of the blowout preventer and to the hydraulic motor of the lock. A second discharge valve is positioned along the second fluid line to delay delivery of fluid to the second portion of the piston cavity to cause sequential opening of the ram coupled to the piston and unlocking of the locking member of the lock.

17 Claims, 8 Drawing Sheets

(58) Field of Classification Search
USPC ..... 251/1.1, 1.3
See application file for complete search history.

(56) References Cited

U.S. PATENT DOCUMENTS

| | | | | | |
|---|---|---|---|---|---|
| 3,941,141 | A * | 3/1976 | Robert | E21B 33/064 | 92/24 |
| 4,519,571 | A * | 5/1985 | Jones | E21B 33/062 | 92/24 |
| 4,969,390 | A | 11/1990 | Williams, III | | |
| 5,361,680 | A * | 11/1994 | Matsui | F15B 15/204 | 92/151 |
| 6,006,647 | A * | 12/1999 | Van Winkle | E21B 33/063 | 92/28 |
| 6,543,594 | B1 | 4/2003 | Fuhrer | | |
| 6,782,799 | B2 * | 8/2004 | Vincent | F15B 15/24 | 92/24 |
| 7,156,169 | B2 | 1/2007 | Bartlett | | |
| 7,300,033 | B1 | 11/2007 | Whitby | | |
| 8,444,109 | B2 * | 5/2013 | Schaeper | E21B 33/062 | 166/85.4 |
| 9,551,200 | B2 | 1/2017 | Read | | |
| 9,957,771 | B2 | 5/2018 | Jaffrey | | |
| 10,190,682 | B2 * | 1/2019 | Paisley | F16H 37/04 | |
| 10,287,843 | B2 * | 5/2019 | Larson | E21B 33/062 | |
| 2008/0048139 | A1 | 2/2008 | Whitby | | |
| 2014/0033842 | A1 | 2/2014 | Morin | | |
| 2017/0191337 | A1 * | 7/2017 | Rey | E21B 34/16 | |
| 2019/0003275 | A1 | 1/2019 | Deul | | |
| 2020/0136356 | A1 | 4/2020 | Schall | | |
| 2020/0156512 | A1 | 5/2020 | Teraguchi | | |
| 2020/0229455 | A1 | 7/2020 | Perez | | |
| 2020/0284274 | A1 | 9/2020 | van Kuilenburg | | |
| 2022/0136356 | A1 | 5/2022 | Poveda | | |
| 2022/0228455 | A1 | 7/2022 | Pujol | | |
| 2023/0203907 | A1 | 6/2023 | Pujol | | |

FOREIGN PATENT DOCUMENTS

| | | | |
|---|---|---|---|
| WO | 2013155206 | A2 | 10/2013 |
| WO | 2020169714 | A1 | 8/2020 |
| WO | 2025221499 | A1 | 10/2025 |

OTHER PUBLICATIONS

Search Report and Written Opinion of International Patent Application No. PCT/US2021/028315 on Jul. 30, 2021; 10 pages.
Office Action issued in U.S. Appl. No. 17/996,559 dated Nov. 27, 2024, 16 pages.
Notice of Allowance issued in U.S. Appl. No. 17/996,559 dated Feb. 4, 2025, 13 pages.

* cited by examiner

LOCK SEQUENCING SYSTEM FOR A BLOWOUT PREVENTER

CROSS REFERENCE PARAGRAPH

This application is a National Stage Entry of International Patent Application No. PCT/US2022/072237, entitled "LOCK SEQUENCING SYSTEM FOR A BLOWOUT PREVENTER," filed May 11, 2022, which claims the benefit of U.S. Provisional Application No. 63/201,798, entitled "LOCK SEQUENCING SYSTEM FOR A BLOWOUT PREVENTER," filed May 13, 2021, the disclosure of which is hereby incorporated herein by reference.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

A blowout preventer (BOP) stack is installed on a wellhead to seal and control an oil and gas well during drilling operations. A drill string may be suspended inside a drilling riser from a rig through the BOP stack into the wellbore. During drilling operations, a drilling fluid is delivered through the drill string and returned up through an annulus between the drill string and a casing that lines the wellbore. In the event of a rapid invasion of formation fluid in the annulus, commonly known as a "kick," a movable component within the BOP stack may be actuated to seal the annulus and to control fluid pressure in the wellbore, thereby protecting well equipment disposed above the BOP stack. In some cases, a cavity lock system may also be operated to lock the movable component to maintain the seal in the annulus.

SUMMARY

According to one or more embodiments of the present disclosure, a lock sequencing system includes a first fluid line that couples a fluid source to a first portion of a piston cavity of a blowout preventer and to a hydraulic motor of a lock; and a first discharge valve positioned along the first fluid line, wherein the first discharge valve is positioned to delay delivery of fluid from the fluid source to the hydraulic motor of the lock to cause sequential closure or a ram coupled to the piston and locking of a locking member of the lock.

According to one or more embodiments of the present disclosure, a system includes a blowout preventer including: a housing that houses opposing rams; a central bore extending through the housing; and an actuator assembly disposed in the housing, the actuator assembly configured to drive the opposing rams between an initial ram position and a final ram position; and a lock sequencing system, including: a first valve; a fluid source configured to provide the fluid through the first valve; and a lock including: at least one lock member; and a hydraulic motor that drives the at least one lock member, wherein the first valve, the fluid source, and the lock are connected via at least one fluid line, and wherein the lock sequencing system sequentially adjusts at least one ram of the opposing rams of the blowout preventer and the at least one lock member of the lock.

According to one or more embodiments of the present disclosure, a method includes: coupling a blowout preventer to a lock sequencing system, wherein the blowout preventer comprises: a housing that houses opposing rams; a central bore extending through the housing; a piston cavity disposed in the housing; and an actuator assembly including: a piston disposed in the piston cavity; and a connecting rod that connects the piston to a corresponding ram of the opposing rams, wherein the actuator assembly is configured to drive the opposing rams between an initial ram position and a final ram position, wherein the lock sequencing system includes: a first valve; a fluid source configured to provide fluid through the first valve; and a lock comprising: at least one lock member; and a hydraulic motor that drives the at least one lock member, pumping the fluid from the fluid source through the first valve of the lock sequencing system; and using the lock sequencing system to sequentially adjust at least one ram of the opposing rams of the blowout preventer and the at least one lock member of the lock.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Figure 1:
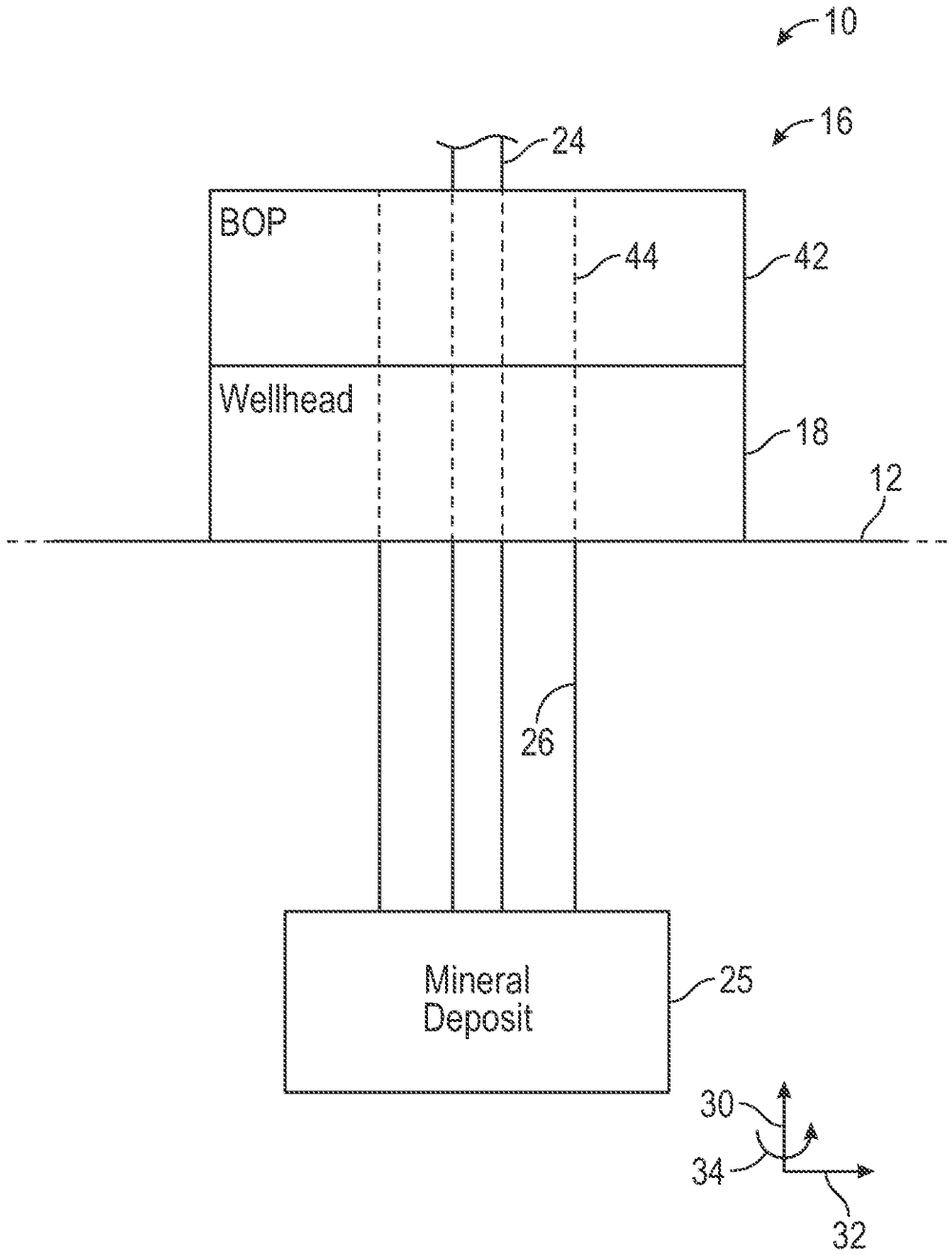
FIG. 1 is a block diagram of a mineral extraction system, in accordance with an embodiment of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present embodiments are generally directed to a lock sequencing system, which may be used as part of a lock (e.g., lock system) for a blowout preventer (BOP). In particular, the lock sequencing system may be used to sequentially adjust one or more rams of the BOP and one or more lock members of the lock. For example, each ram may be configured to adjust from an initial ram position (e.g., open position; first position) in which the ram is withdrawn from a central bore of the BOP to a final ram position (e.g., closed position; second position) in which the ram is positioned within the central bore of the BOP. Each lock member may be configured to adjust from an unlock position (e.g., a first lock member position) in which the lock member does not block movement of the ram to a lock position (e.g., a second lock member position) in which the lock member locks the ram in the final ram position (e.g., to block the movement of the ram from the final ram position to the initial ram position; to block withdrawal/movement of the ram backward from the central bore). The lock sequencing system may include features (e.g., sequencing valves) that sequentially adjust the ram to the final ram position and then adjust the lock member to the lock position and/or that sequentially adjust the lock member to the unlock position and then adjust the ram to the initial ram position. The lock sequencing system may be packaged in a control block that is configured to couple to a lock housing of the lock and/or a BOP housing of the BOP.

While the disclosed embodiments are described in the context of a drilling system and drilling operations to facilitate discussion, it should be appreciated that the BOP may be adapted for use in other contexts and other operations. As one example, the BOP may be used in a pressure control equipment (PCE) stack that is coupled to and/or positioned vertically above a wellhead during various intervention operations (e.g., inspection or service operations), such as wireline operations in which a tool supported on a wireline is lowered through the PCE stack to enable inspection and/or maintenance of a well. In such cases, the BOP may be adjusted from an open configuration (e.g., open position) to a closed configuration (e.g., closed position (e.g., to seal around the wireline extending through the PCE stack)) to isolate the environment, as well as other surface equipment, from pressurized fluid within the well. As another example, the BOP may be used in coil tubing operations. In the present disclosure, a conduit may be any of a variety of tubular or cylindrical structures, such as a drill string, casing, wireline, Streamline™, slickline, coiled tubing, or other spoolable rod.

Furthermore, while the disclosed embodiments are described in the context of the BOP, it should be appreciated that the lock sequencing system may be employed to lock other components in any of a variety of mineral extraction systems or other types of systems. Furthermore, while the disclosed embodiments are described in the context of a rotary lock, it should be appreciated that the lock sequencing system may be employed with any of a variety of types of hydraulic locks, such as wedge locks, ST locks, Rotary lock and/or EVO Lock. It can also be used to retrofit and/or upgrade existing (e.g., previously installed) BOPs and/or equipment manufactured by any of a variety of manufacturers and/or implemented by any of a variety of businesses.

With the foregoing in mind, FIG. 1 is a block diagram of an embodiment of a mineral extraction system 10. The mineral extraction system 10 may be configured to extract various minerals and natural resources, including hydrocarbons (e.g., oil and/or natural gas), from the earth, or to inject substances into the earth. The mineral extraction system 10 may be a land-based system (e.g., a surface system) or an offshore system (e.g., an offshore platform system). A BOP assembly 16 is mounted to a wellhead 18, which is coupled to a mineral deposit via a wellbore 26. The wellhead 18 may include any of a variety of other components, such as a spool, a hanger, and a "Christmas" tree. The wellhead 18 may return drilling fluid or mud to the surface 12 during drilling operations, for example. Downhole operations are carried out by a conduit 24 that extends through the BOP assembly 16, through the wellhead 18, and into the wellbore 26.

To facilitate discussion, the BOP assembly 16 and its components may be described with reference to a vertical axis or direction 30, a longitudinal axis or direction 32, and a lateral axis or direction 34. The BOP assembly 16 may include one or more BOPs 42 (e.g., 1, 2, 3, 4, 5, 6, 7, 8 or more ram BOPs) stacked relative to one another. A central bore 44 (e.g., flow bore) extends through the one or more BOPs 42. As discussed in more detail herein, at least one of the BOPs 42 may include or be coupled to a lock (e.g., hydraulic lock; cavity lock) that is configured to lock the BOP 42 in a closed configuration (e.g., closed position) in which the BOP 42 blocks a fluid flow through the central bore 44. For example, a lock member may move toward the central bore 44 to block movement of a ram of the BOP 42 while the ram is positioned within the central bore 44 to thereby lock the BOP 42 in the closed configuration.

Figure 2:
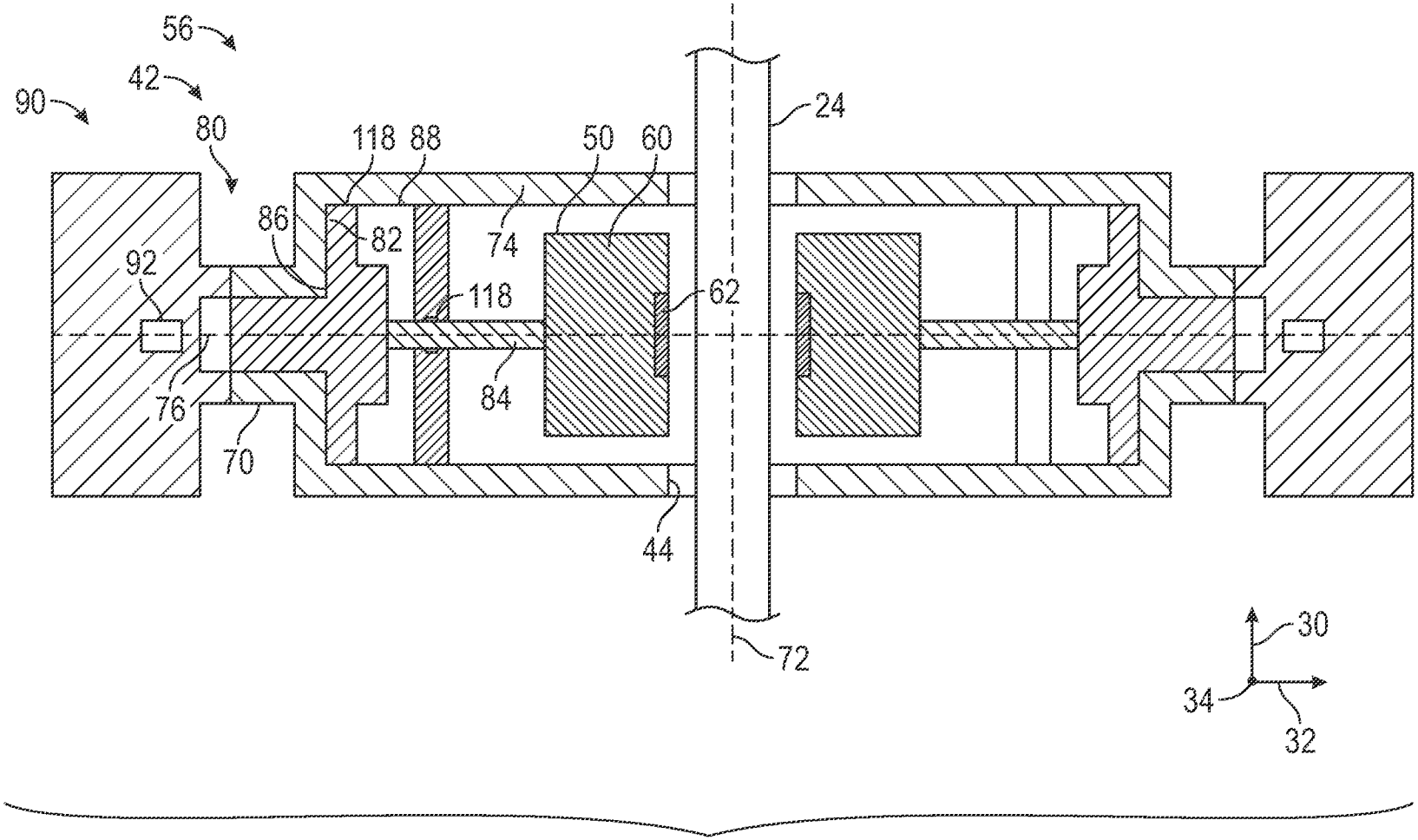
FIG. 2 is cross-sectional side view of a blowout preventer (BOP) that may be used in the mineral extraction system of FIG. 1, wherein rams are withdrawn from a central bore of the BOP, in accordance with an embodiment of the present disclosure.
Figure 3:
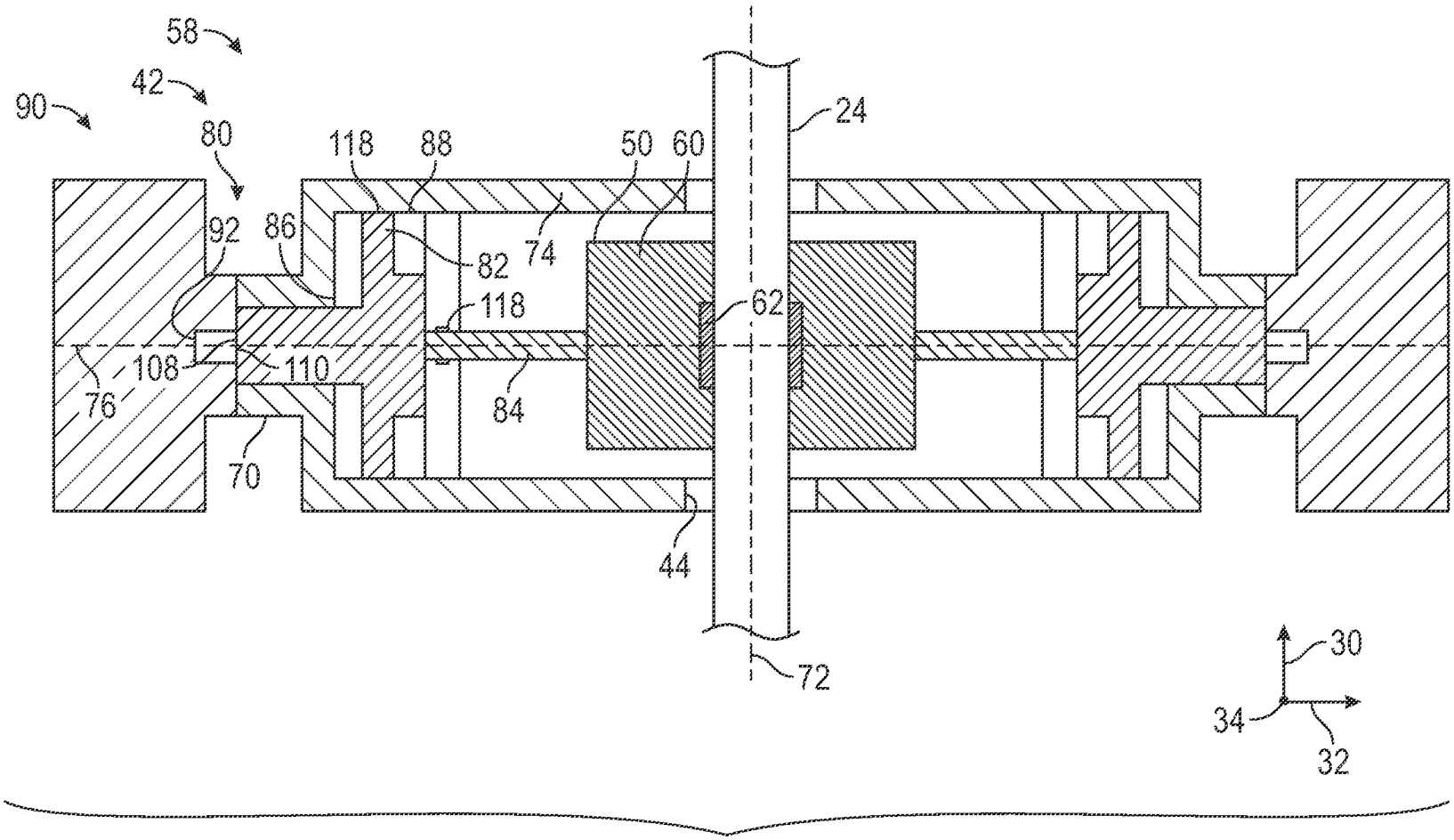
FIG. 3 is a cross-sectional side view of the BOP of FIG. 2, wherein the rams are within the central bore of the BOP, in accordance with an embodiment of the present disclosure.

FIGS. 2 and 3 are cross-sectional side views of an embodiment of a BOP 42 that may be used in the mineral extraction system 10 of FIG. 1. In FIG. 2, each ram 50 of the BOP 42 is in an initial ram position (e.g., open position; first position). In the initial ram position, each ram 50 is withdrawn from the central bore 44, enables a fluid flow through the central bore 44, does not contact the conduit 24, and/or does not contact a corresponding opposed ram 50. In FIG. 3, each ram 50 of the BOP 42 is in a final ram position (e.g., closed position; second position). In the final ram position, the ram 50 extends into the central bore 44, blocks the fluid flow through the central bore 44, contacts the conduit 24, and/or contacts the corresponding opposed ram 50. While the ram 50 is in the initial ram position, the BOP 42 may be in an open configuration 56 (e.g., open position) in which the BOP 42 enables the fluid flow through the central bore 44. While each ram 50 is in the final ram position, the BOP 42 may be in a closed configuration 58 (e.g., closed position) in which the BOP 42 blocks the fluid flow through the central bore 44. For example, each ram 50 may include a ram body 60 and a sealing element 62 (e.g., packer), and the sealing elements 62 of the opposed rams 50 may contact and seal against the conduit 24 to thereby seal an annulus about the conduit 24 to block the fluid flow through the central bore 44. It should be appreciated that the rams 50 may be configured to seal the central bore 44 without the conduit 24 (e.g., the sealing elements 62 of the opposed rams 50 may contact and seal against one another to seal the central bore 44).

As shown, the BOP 42 includes a housing 70 that houses each ram 50. In particular, the central bore 44 has a bore central axis 72 (e.g., aligned with the vertical axis 30) and extends through the housing 70. The housing 70 also defines a cavity 74 (e.g., ram cavity) that has a cavity central axis 76 (e.g., aligned with the longitudinal axis 32) and intersects the central bore 44 (e.g., the bore central axis 72 and the cavity central axis 76 are transverse or orthogonal to one another). This configuration enables each ram 50 to move between the open position in which the ram 50 is withdrawn from the central bore 44 and positioned within the cavity 74 to the closed position in which the ram 50 is positioned within the central bore 44 and extends from cavity 74.

The housing 70 may also house components of an actuator assembly 80 that drives each ram 50 between the initial ram position and the final ram position. For example, in the illustrated embodiment, the actuator assembly 80 includes a respective piston 82 and a respective connecting rod 84 for each ram 50. In operation, upon an increase in wellbore pressure or upon another indication that the BOP 42 should be adjusted to the closed configuration 58, a fluid may be provided into a respective first piston cavity portion 86 to drive the respective pistons 82, as well as the respective connecting rods 84 and the respective rams 50 coupled thereto, toward the central bore 44. In this way, each ram 50 may be driven from the initial ram position of FIG. 2 to the final ram position of FIG. 3. Furthermore, upon another indication that the BOP 42 should be adjusted to the open configuration, a fluid may be provided into a respective second piston cavity portion 88 to drive the respective pistons 82, as well as the respective connecting rods 84 and the respective rams 50 coupled thereto, away the central bore 44. In this way, each ram 50 may be driven from the final ram position of FIG. 3 to the initial ram position of FIG. 2. As shown, various seals 118 (e.g., annular seals) may be provided to seal and/or to isolate certain cavities.

While the housing 70 is illustrated as a one-piece housing that encompasses both the rams 50 and the pistons 82 to facilitate discussion, it should be appreciated that the housing 70 may include a first housing that encompasses the rams 50 and a second housing that encompasses the pistons 82. In such cases, the first housing may be a BOP ram housing and the second housing may be a bonnet housing, and the BOP ram housing and the bonnet housing may be coupled to one another (e.g., via fasteners).

As shown, the BOP 42 may include or be associated with a lock 90 (e.g., hydraulic lock; cavity lock) that includes one or more lock members 92. In the illustrated embodiment, one lock 90 is provided for each ram 50 (e.g., a first lock and a second lock positioned on opposite sides of the rams 50 along the longitudinal axis 32). Furthermore, each lock 90 includes one lock member 92. However, any number of locks 90 having any number of lock members 92 (e.g., 1, 2, 3, 4, 5, 6, 7, 8 or more) may be provided in any of a variety of configurations. Additionally, it should be appreciated that the lock members 92 may have any of a variety of configurations (e.g., cross-sectional shapes, sizes, positions) and may move in any of a variety of ways.

Each lock member 92 is configured to move from an unlock position (e.g., first lock position or configuration), which is shown in FIG. 2, to a lock position (e.g., second lock position or configuration), which is shown in FIG. 3. In the unlock position, the lock member 92 may be withdrawn relative to the housing 70 and does not block movement of the ram 50. In the lock position, the lock member 92 may be extended relative to the housing 70 and blocks movement of the ram 50 (e.g., via contact with the actuator assembly 80). In particular, the lock member 92 is configured to engage the piston 82 (e.g., a tailrod portion of the piston 82) to block movement of the ram 50 from the final ram position to the initial ram position (e.g., to block withdrawal of the ram 50 from the central bore 44), thereby locking the ram 50 in the final ram position to lock the BOP 42 in the closed configuration 58.

With reference to FIG. 3, an actuator-contacting surface 108 (e.g., longitudinally-facing surface) of the lock member 92 may contact with a lock-contacting surface 110 (e.g., longitudinally-facing surface) of the piston 82. In the illustrated embodiment, the lock-contacting surface 110 of the piston 82 faces away from the central bore 44 and/or is a rearmost surface of the piston 82 (e.g., furthest from the central bore 44). However, it should be appreciated that the lock member 92 may be configured to contact and engage another surface of the piston 82 or any other surface of the actuator assembly 80 and/or the ram 50 (e.g., a surface; a recess formed in a surface). Furthermore, while the illustrated embodiment shows the lock member 92 extending and moving longitudinally relative to the housing 70 (e.g., along the longitudinal axis 32), it should be appreciated that the lock member 92 may extend and move laterally (e.g., along the lateral axis 34) and/or vertically (e.g., along the vertical axis 30). For example, instead of or in addition to being positioned on opposite sides of the housing 70 along the longitudinal axis 32, the lock members 92 may be positioned on opposite sides of the housing 70 along the lateral axis 34. As discussed in more detail herein, a lock sequencing system may operate to sequentially adjust the ram 50 and the lock member 92 to perform locking and unlocking functions for the BOP 42.

Figure 4:
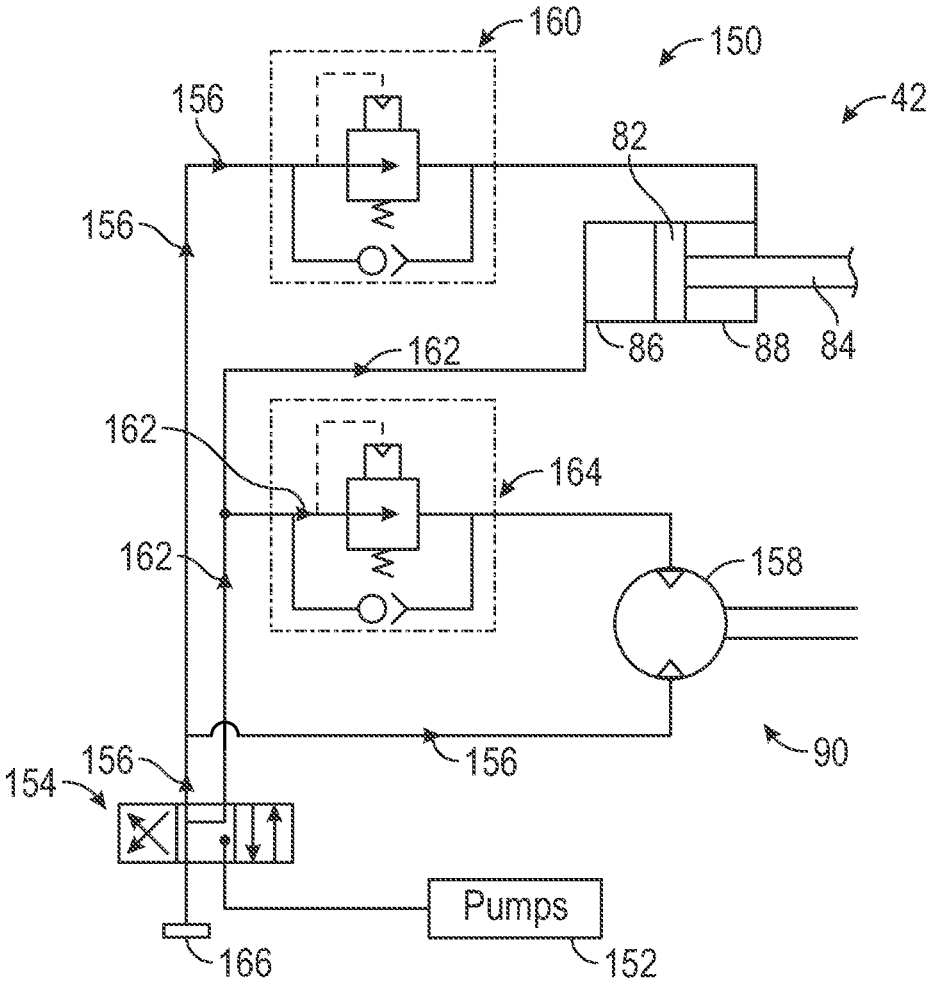
FIG. 4 is a hydraulic circuit diagram that illustrates features of a lock sequencing system that may be used with the BOP of FIGS. 2 and 3, in accordance with an embodiment of the present disclosure.

FIGS. 4-11 illustrate various features of an embodiment of a lock sequencing system 150. In particular, FIG. 4 is a hydraulic circuit diagram that illustrates features of the lock sequencing system 150. As shown, a fluid source 152 (e.g., pump) is configured to provide a fluid (e.g., pressurized fluid) through a first valve 154 (e.g., three-position valve). When the first valve 154 is in a first position, the fluid flows through a line (e.g., or multiple connected lines) as shown by arrows 156. The fluid reaches a hydraulic motor 158 of the lock 90, thereby causing the hydraulic motor 158 to drive the lock member 92 to the unlock position. The fluid also reaches a ram-opening valve 160 (e.g., sequencing valve; a pilot line of the ram-opening valve 160) that is configured to open in response to a pressure of the fluid reaching a threshold (e.g., about 1000, 1200, 1500, or more pounds per square inch [psi]). The threshold may be reached when the lock member 92 has reached the unlock position. This may cause a delay in the movement of the ram 50 relative to the movement of the lock member 92. When the ram-opening valve 160 is open, the fluid reaches the respective second piston cavity portion 88 and drives the piston 82 (as well as the connecting rod 84 coupled thereto) away from the central bore 44 of the BOP 42. In this way, one command or instruction to move the first valve 154 to the first position results in the fluid driving the lock member 92 to or toward the unlock position and then driving the ram 50 to the open position automatically in a sequential manner.

When the first valve 154 is in a second position, the fluid flows through a line (or multiple connected lines) as shown by arrows 162. The fluid reaches the respective first piston cavity portion 86 and drives the piston 82 (as well as the connecting rod 84 coupled thereto) toward from the central bore 44 of the BOP 42. The fluid also reaches a locking valve 164 (e.g., sequencing valve; a pilot line of the locking valve 164) that is configured to open in response to a pressure of the fluid reaching a threshold (e.g., about 1000, 1200, 1500, or more psi). The threshold may be reached when the rams 50 are in the closed position and the packers of the rams 50 are being energized. This may cause a delay in the movement of the lock member 92 relative to the movement of the ram 50. When the locking valve 164 is open, the fluid reaches the hydraulic motor 158 of the lock 90, thereby causing the hydraulic motor 158 to drive the lock member 92 to the lock position. In this way, one command or instruction to move the first valve 154 to the second position results in the fluid driving the ram 50 to or toward the closed position and then driving the lock member 92 to the lock position automatically in a sequential manner. When the first valve 154 is in a third position, the lines may be isolated from the fluid source 152 and may be coupled to a drain reservoir 166.

Figure 5:
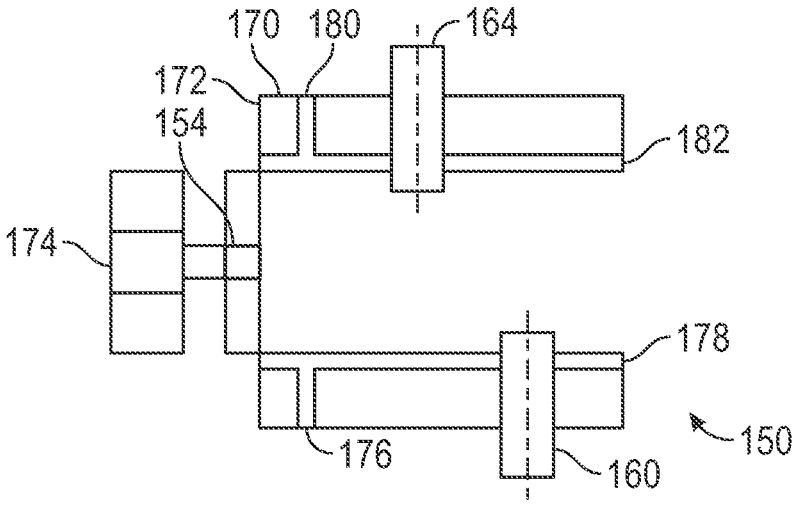
FIG. 5 is a schematic diagram that illustrates features of the lock sequencing system of FIG. 4 packaged within a control block, in accordance with an embodiment of the present disclosure.
Figure 6:
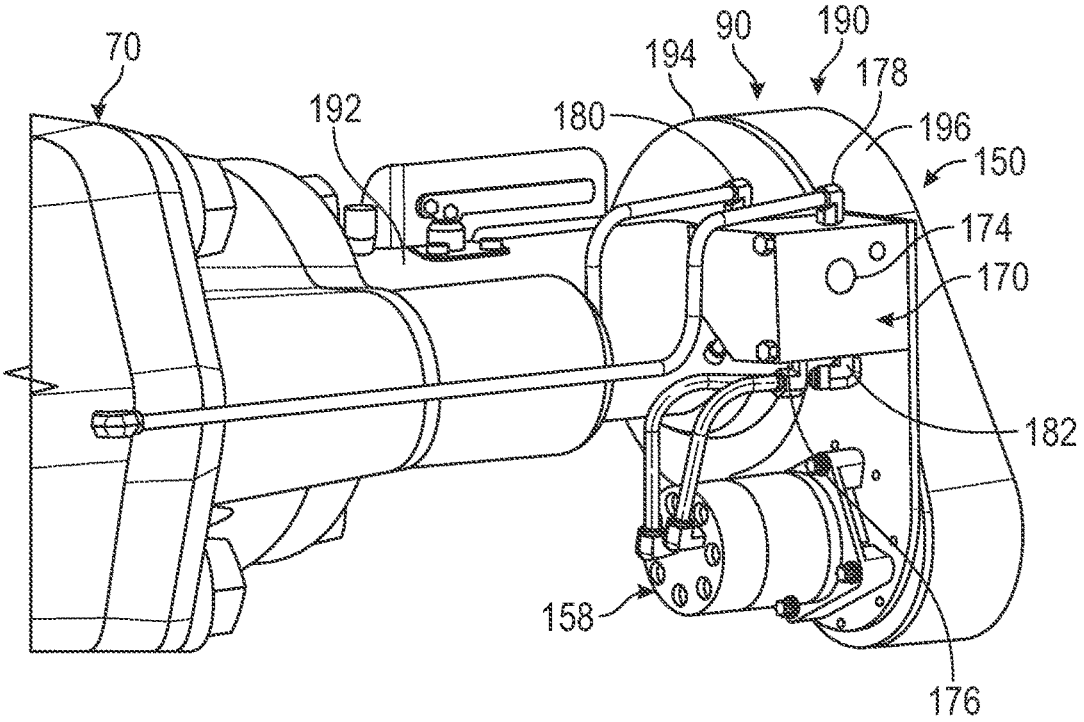
FIG. 6 is a perspective view of a portion of a lock with the lock sequencing system of FIG. 4, in accordance with an embodiment of the present disclosure.
Figure 7:
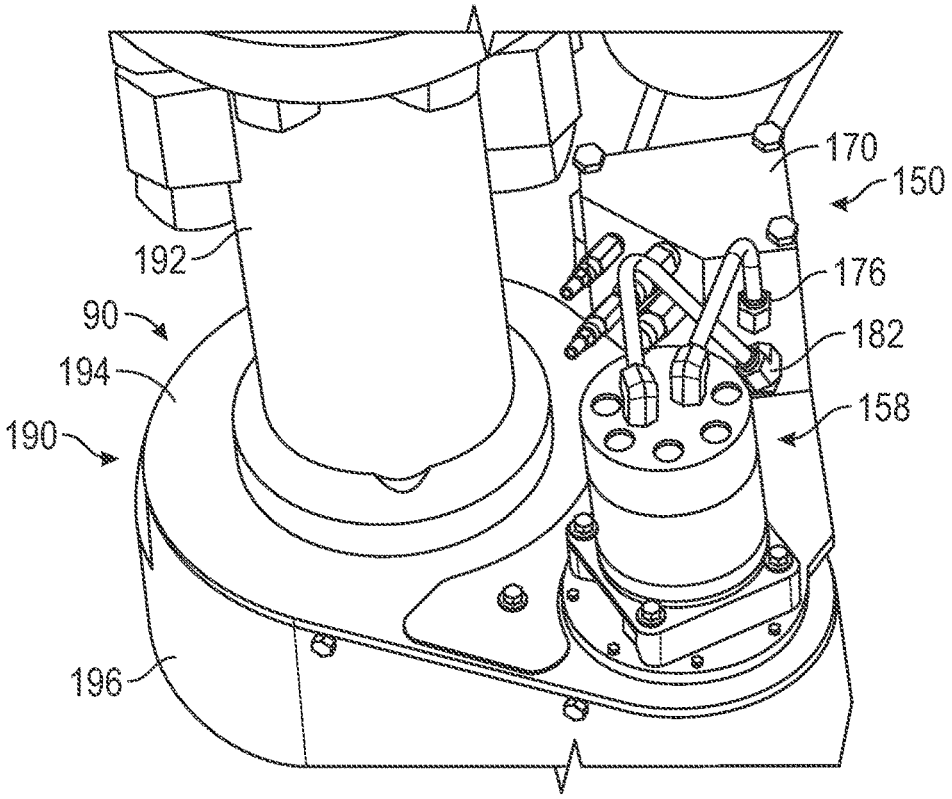
FIG. 7 is a perspective view of a portion of the lock of FIG. 6, in accordance with an embodiment of the present disclosure.
Figure 8:
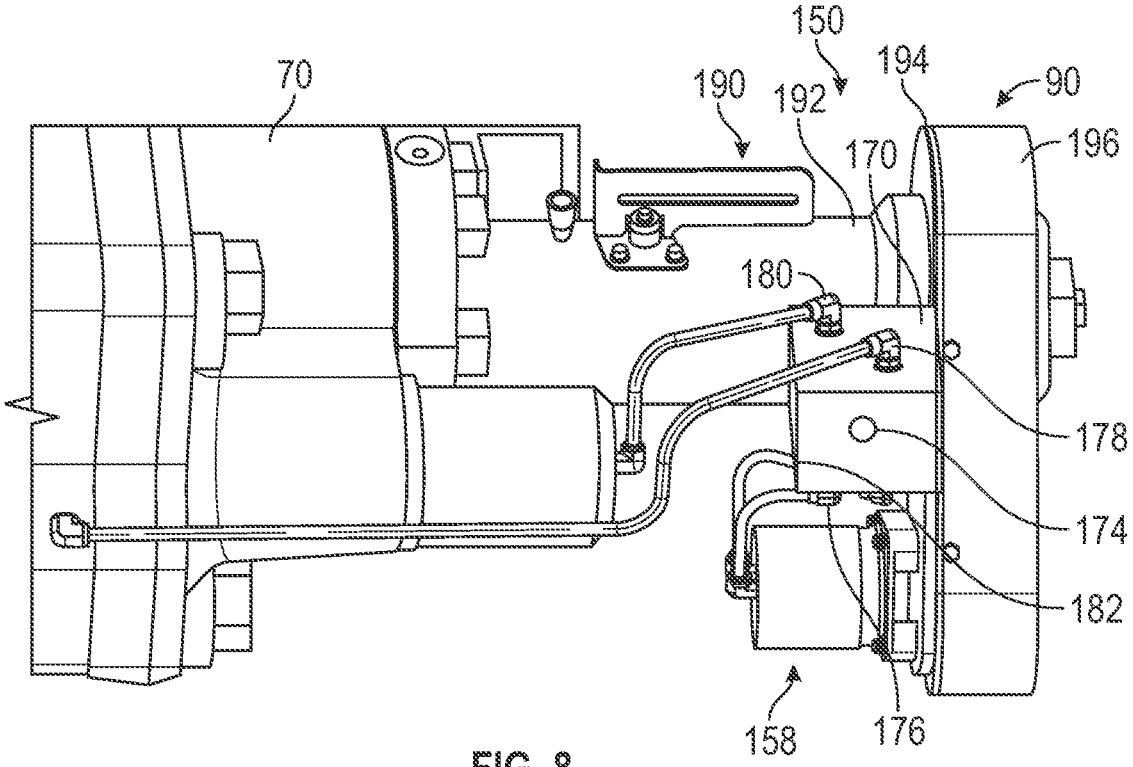
FIG. 8 is a side view of a portion of the lock of FIG. 6, in accordance with an embodiment of the present disclosure.
Figure 9:
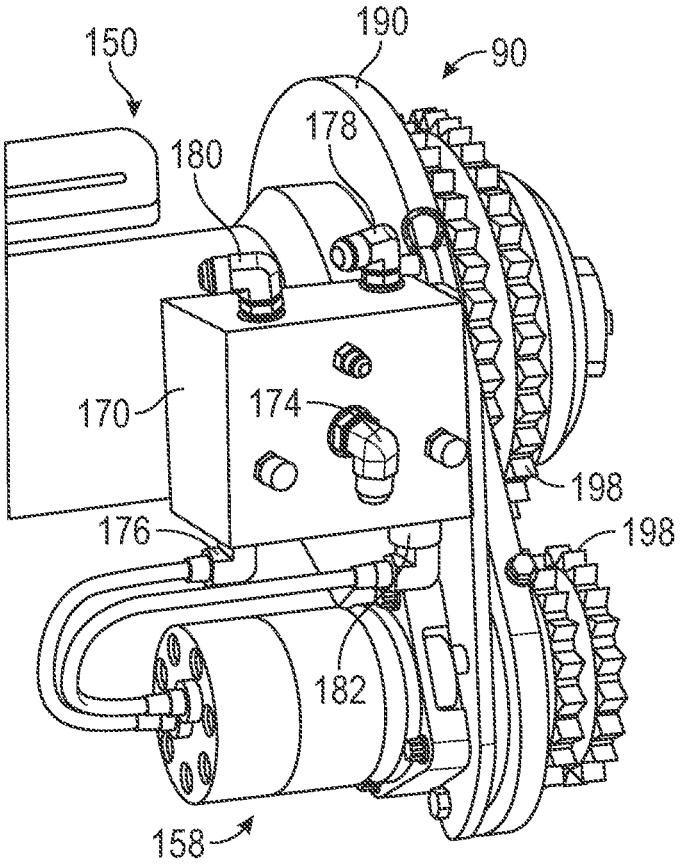
FIG. 9 is a perspective view of a portion of the lock of FIG. 6, wherein a housing is removed to illustrate certain components, in accordance with an embodiment of the present disclosure.
Figure 10:
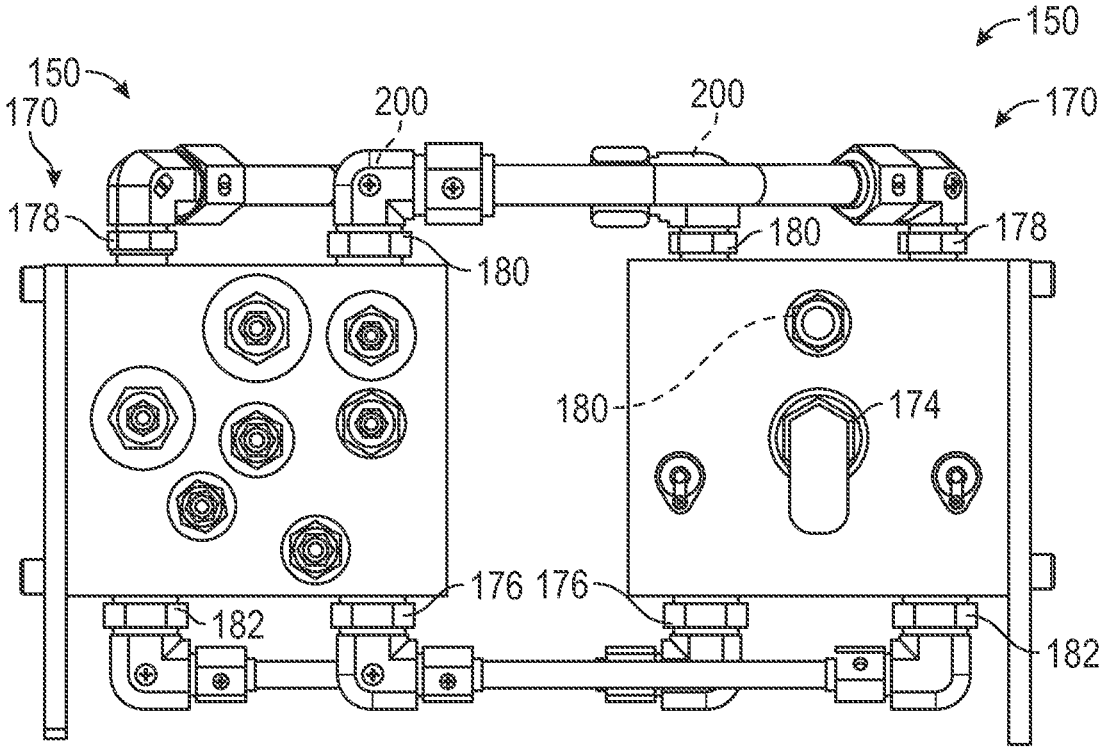
FIG. 10 is a right side view and a left side view of the control block of FIG. 5, in accordance with an embodiment of the present disclosure.
Figure 11:
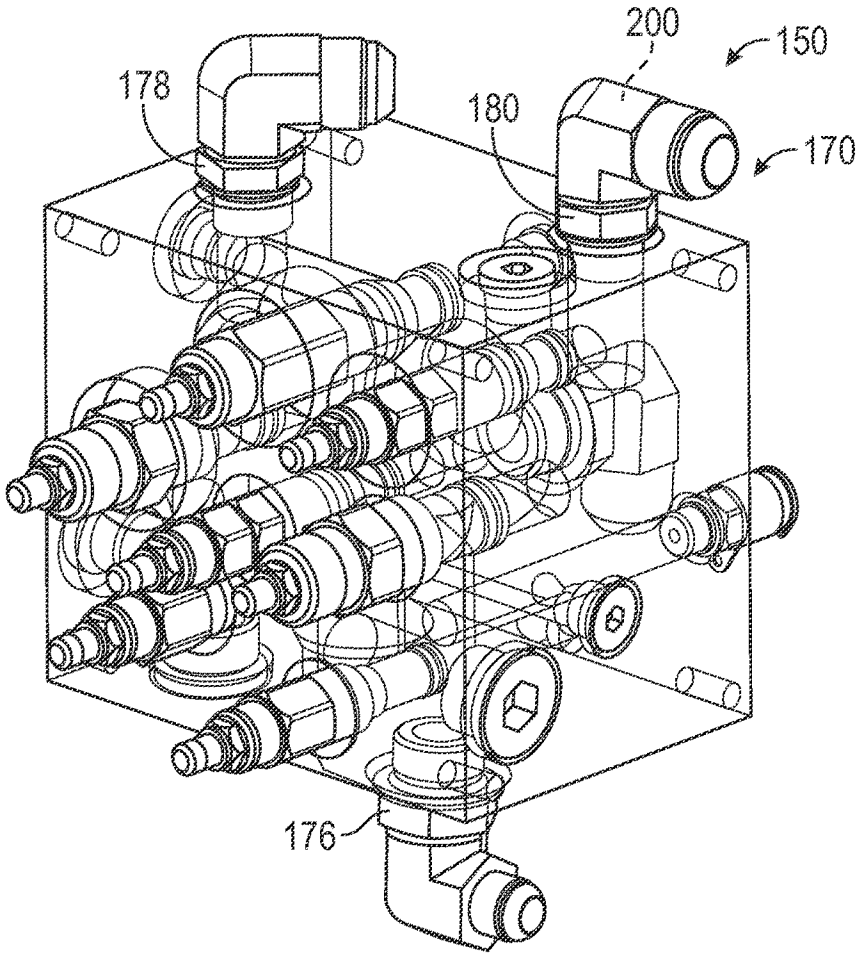
FIG. 11 is a right side perspective view and a left side perspective view of the control block of FIG. 5, in accordance with an embodiment of the present disclosure.
Figure 11:
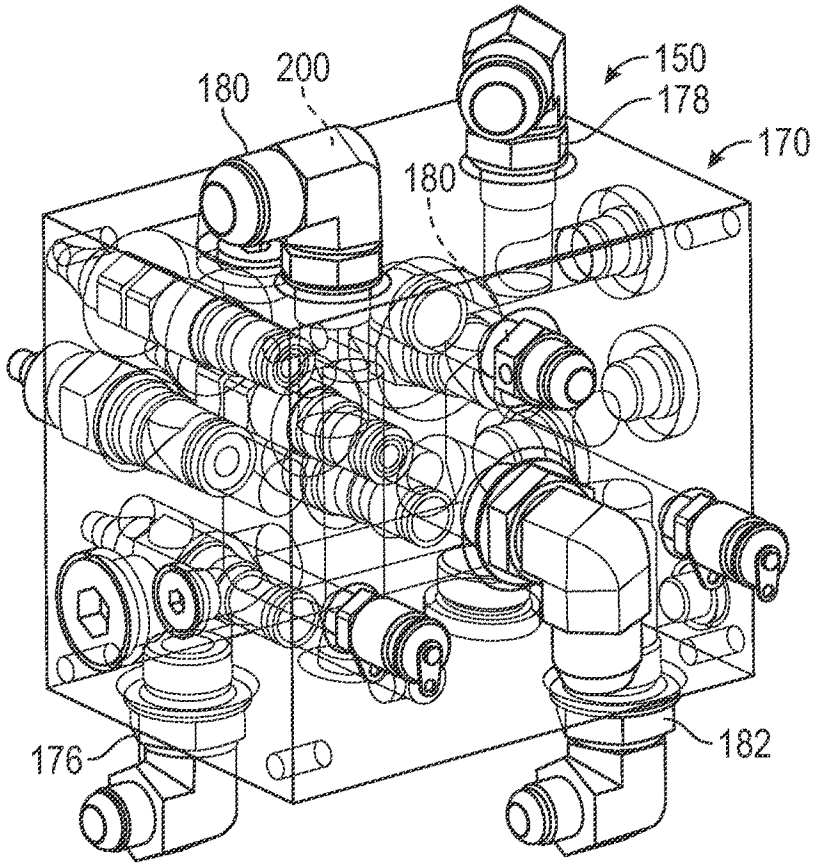

FIG. 5 is a schematic diagram that illustrates features of the lock sequencing system 150 packaged within a control block 170. As shown, the control block 170 may be defined by a housing 172. The fluid from the fluid source 152 may enter through a main inlet and/or outlet 174 formed in the housing 172. In some embodiments, the first valve 154 may be positioned downstream from the main inlet 174 (e.g., within the control block 170). When the first valve 154 is in the first position, the fluid may be directed through a first inlet and/or outlet 176 to drive the lock member 92 to the unlock position and to the ram-opening valve 160, which eventually opens due to fluid pressure to provide the fluid to a second inlet and/or outlet 178 to drive the ram 50 to the open position. When the first valve 154 is in the second position, the fluid may be directed through a third inlet and/or outlet 180 to drive the ram 50 to the closed position and to the locking valve 164, which eventually opens due to fluid pressure to provide the fluid to a fourth inlet and/or outlet 182 to drive the lock member 92 to the lock position. The ram-opening valve 160 and the locking valve 164 may be individual valve cartridges that are accessible and removable to facilitate maintenance operations (e.g., inspection, repair, and/or replacement).

FIGS. 6-9 illustrate the control block 170 of the lock sequencing system 150 coupled to the lock 90. In particular, the control block 170 of the lock sequencing system 150 is coupled to a lock housing 190 (e.g., via fasteners), which may be coupled to the housing 70 (e.g., bonnet housing; via fasteners) that surrounds the piston 82 of the actuator assembly 80 of the BOP 42. The lock housing 190 may be a multi-part housing that includes a lock member portion 192 that surrounds the lock member 92, a support plate 194 that supports the hydraulic motor 158, and a cover 196 that surrounds gears 198 that drive rotation and axial movement of the lock member 92 to adjust the lock member 92 between the lock position and the unlock position.

As shown, the control block 170 includes the main inlet and/or outlet 174, the first inlet and/or outlet 176 to drive the lock member 92 to the unlock position, the second inlet and/or outlet 178 to drive the ram 50 to the open position, the third inlet and/or outlet 182 to drive the ram 50 to the closed position, and the fourth inlet and/or outlet 182 to drive the lock member 92 to the lock position. However, it should be appreciated that other configurations or arrangements of the various inlets and/or outlets are envisioned. For example, with reference to FIGS. 10 and 11, an alternative location for the fourth inlet and/or outlet 180 is shown with a dashed line. In that case, an additional main inlet and/or outlet 200 as shown with a dashed line may be coupled to the fluid source 152. Then, the fluid through the main inlet and/or outlet 174 may operate the unlock/open function (e.g., via being fluidly coupled to the first inlet and/or outlet 176, the ram-opening valve 160, and the second inlet and/or outlet 178). Furthermore, the fluid through the additional main inlet and/or outlet 200 may operate the lock/close function (e.g., via being fluidly coupled to the third inlet and/or outlet 180, the locking valve 164, and the fourth inlet and/or outlet 182 as shown with the dashed line). In this case, the first valve 154 may be located upstream of the main inlet and/or outlet 174 and the additional main inlet and/or outlet 200 (e.g., outside of the control block 170).

Advantageously, the lock sequencing system may provide reliable, repeatable operation. Furthermore, the lock sequencing system may be retrofitted to existing locks and/or be accessible for efficient maintenance operations (e.g., inspection, repair, and/or replacement). Instead of relying on any electronic controller to implement time delays via separate control of four different valves for four separate functions (e.g., open, close, lock, unlock), the lock sequencing system automatically provides time delays via placement of a discharge valve along a line to link the unlock/open functions and the close/lock functions. The lock sequencing system provides a physical check that the certain operations are proceeding (e.g., via the increase in pressure), which may reduce damage to the lock and/or the BOP, for example.

It should be appreciated that any of the features illustrated and described with respect to FIGS. 1-11 may be combined in any suitable manner. While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A lock sequencing system, comprising:

a first fluid line that couples a fluid source to a first portion of a piston cavity of a blowout preventer and to a hydraulic motor of a lock;

a first discharge valve positioned along the first fluid line, wherein the first discharge valve is positioned to delay delivery of fluid from the fluid source to the hydraulic motor of the lock to cause sequential closure of a ram coupled to a piston and locking of a locking member of the lock; and a control block that supports the first discharge valve and comprises a main inlet that is configured to receive the fluid from the fluid source, a first outlet that is configured to provide the fluid to the first portion of the piston cavity of the blowout preventer, and a second outlet that is configured to provide the fluid to the hydraulic motor of the lock.

2. The lock sequencing system of claim 1, comprising:

a second fluid line that couples the fluid source to a second portion of the piston cavity of the blowout preventer and to the hydraulic motor of the lock; and a second discharge valve positioned along the second fluid line, wherein the second discharge valve is positioned to delay delivery of fluid from the fluid source to the second portion of the piston cavity of the blowout preventer to cause sequential opening of the ram coupled to the piston and unlocking of the locking member of the lock.

3. The lock sequencing system of claim 1, wherein the control block is configured to be fastened to a lock housing of the lock.

4. The lock sequencing system of claim 1, wherein the lock sequencing system is configured to be retrofitted to a hydraulic lock system of the blowout preventer.

5. A system, comprising:

a blowout preventer comprising:

a housing that houses opposing rams;

a central bore extending through the housing; and an actuator assembly disposed in the housing, the actuator assembly configured to drive the opposing rams between an initial ram position and a final ram position; and a lock sequencing system, comprising:

a first valve;

a fluid source configured to provide fluid through the first valve;

a lock comprising:

at least one lock member; and a hydraulic motor that drives the at least one lock member; and a control block coupled to the lock, wherein the first valve, the fluid source, and the lock are connected via at least one fluid line, wherein the lock sequencing system sequentially adjusts at least one ram of the opposing rams of the blowout preventer and the at least one lock member of the lock, and wherein the control block comprises:

a main inlet in fluid communication with the first valve;

a first outlet that is configured to drive the at least one lock member to an unlock position;

a second outlet that is configured to drive the at least one ram of the opposing rams to the initial ram position;

a third outlet that is configured to drive the at least one ram of the opposing rams to the final ram position; and a fourth outlet that is configured to drive the at least one lock member to a lock position.

6. The system of claim 5, wherein, in the initial ram position, the opposing rams are withdrawn from the central bore, wherein, in the final ram position, the opposing rams are positioned within the central bore, wherein the first valve is configured to move to a first position, resulting in the fluid driving the at least one lock member toward the unlock position, and then driving a corresponding ram of the opposing rams automatically and sequentially to the initial ram position, and wherein the first valve is configured to move to a second position, resulting in the fluid driving the corresponding ram of the opposing rams toward the final ram position, and then driving the at least one lock member automatically and sequentially to the lock position.

7. The system of claim 6, wherein the lock sequencing system further comprises:

a ram-opening valve that is configured to open in response to a pressure of the fluid reaching a first threshold; and a locking valve that is configured to open in response to the pressure of the fluid reaching a second threshold, wherein the first valve, the fluid source, the lock, the ram-opening valve, and the locking valve are connected via the at least one fluid line.

8. The system of claim 7, wherein the first threshold is reached when the at least one lock member has reached the unlock position, and wherein the second threshold is reached when the opposing rams are in the final ram position.

9. The system of claim 7, wherein the blowout preventer further comprises a piston cavity disposed in the housing, wherein the actuator assembly comprises:

a piston disposed in the piston cavity; and a connecting rod that connects the piston to the corresponding ram of the opposing rams.

10. The system of claim 7, wherein, when the ram-opening valve is open, the fluid reaches a portion of the piston cavity and drives the piston and the connecting rod connected thereto away from the central bore of the blowout preventer, and wherein, when the locking valve is open, the fluid reaches the hydraulic motor of the lock, thereby causing the hydraulic motor to drive the at least one lock member to the lock position.

11. The system of claim 5, wherein the blowout preventer further comprises a piston cavity disposed in the housing, wherein the actuator assembly comprises:

a piston disposed in the piston cavity; and a connecting rod that connects the piston to the corresponding ram of the opposing rams.

12. A method, comprising:

coupling a blowout preventer to a lock sequencing system, wherein the blowout preventer comprises:

a housing that houses opposing rams;

a central bore extending through the housing;

a piston cavity disposed in the housing; and an actuator assembly comprising:

a piston disposed in the piston cavity; and a connecting rod that connects the piston to a corresponding ram of the opposing rams, wherein the actuator assembly is configured to drive the opposing rams between an initial ram position and a final ram position, wherein the lock sequencing system comprises:

a first valve;

a fluid source configured to provide fluid through the first valve;

a lock comprising:

at least one lock member; and a hydraulic motor that drives the at least one lock member; and a control block coupled to the lock, wherein the control block comprises:

a main inlet in fluid communication with the first valve;

a first outlet that is configured to drive the at least one lock member to an unlock position;

a second outlet that is configured to drive at least one ram of the opposing rams to the initial ram position;

a third outlet that is configured to drive the at least one ram of the opposing rams to the final ram position; and a fourth outlet that is configured to drive the at least one lock member to a lock position, wherein the first valve, the fluid source, and the lock are connected via at least one fluid line;

pumping the fluid from the fluid source through the first valve of the lock sequencing system; and using the lock sequencing system to sequentially adjust the at least one ram of the opposing rams of the blowout preventer and the at least one lock member of the lock.

13. The method of claim 12, further comprising:

moving the first valve to a first position, resulting in the fluid driving the at least one lock member toward the unlock position; and driving the corresponding ram of the opposing rams automatically and sequentially to the initial ram position, wherein, in the initial ram position, the opposing rams are withdrawn from the central bore.

14. The method of claim 13, further comprising:

moving the first valve to a second position, resulting in the fluid driving the corresponding ram of the opposing rams toward the final ram position, wherein, in the final ram position, the opposing rams are positioned within the central bore; and driving the at least one lock member automatically and sequentially to the lock position.

15. The method of claim 14, wherein the lock sequencing system further comprises: a ram-opening valve; and a locking valve, the method further comprising:

opening the ram-opening valve in response to a pressure of the fluid reaching a first threshold; and opening the locking valve in response to the pressure of the fluid reaching a second threshold.

16. The method of claim 15, wherein the first threshold is reached when the at least one lock member has reached the unlock position, and wherein the second threshold is reached when the opposing rams are in the final ram position.

17. The method of claim 12, further comprising:

moving the first valve to a second position, resulting in the fluid driving the corresponding ram of the opposing rams toward the final ram position, wherein, in the final ram position, the opposing rams are positioned within the central bore; and driving the at least one lock member automatically and sequentially to the lock position.

* * * * *